United States Patent [19]

Plantier

[11] 4,209,788

[45] Jun. 24, 1980

[54] ANTENNA MOUNTING BRACKET

[76] Inventor: George W. Plantier, 14 Farview Ave., Wolcott, Conn. 06716

[21] Appl. No.: 869,249

[22] Filed: Jan. 13, 1978

[51] Int. Cl.[2] ..... H01Q 1/32

[52] U.S. Cl. ..... 343/713; 343/715

[58] Field of Search ..... 343/711–715, 343/888, 900, 901, 883, 872, 904–906; 248/539

[56] References Cited

U.S. PATENT DOCUMENTS 3,852,757 12/1974 Kaiser ..... 343/713

FOREIGN PATENT DOCUMENTS 1238407 6/1959 France ..... 343/715

*Primary Examiner*—David K. Moore

*Attorney, Agent, or Firm*—McCormick, Paulding & Huber

[57] ABSTRACT

A detachable antenna mounting bracket for attachment to an external rear view mirror support member on a truck or the like. The mounting bracket carries an antenna bushing assembly and is releasably secured to the mirror support member by a single clamping screw. A lip on the mounting frame cooperates with the clamping screw to prevent separation of the mounting bracket from the support member if the clamping screw should loosen due to road vibration.

4 Claims, 6 Drawing Figures

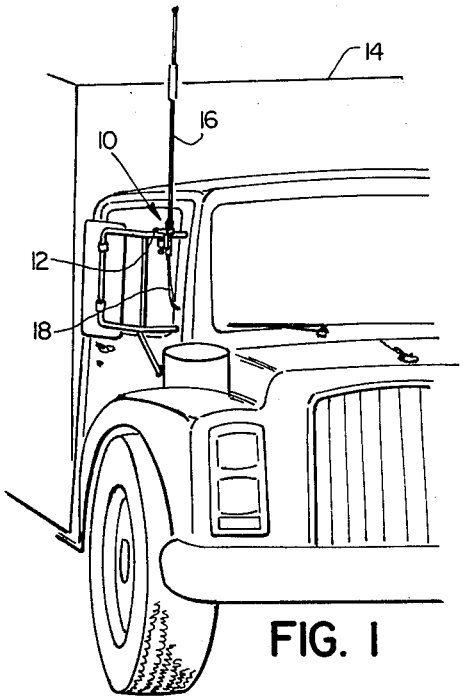
FIG. 1
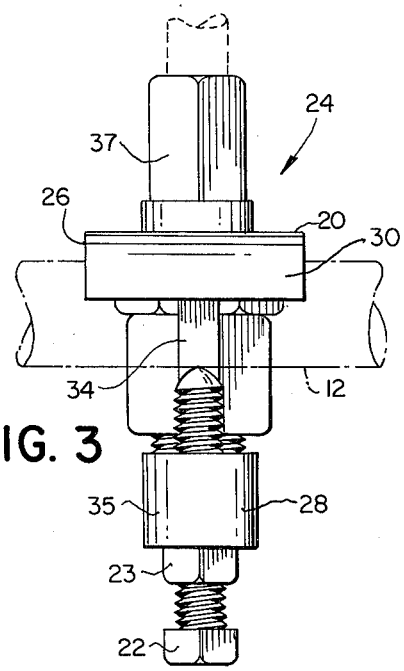
FIG. 3
FIG. 4
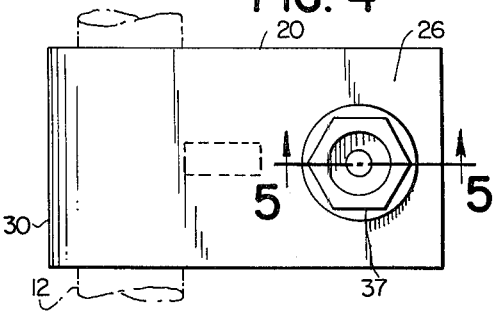
FIG. 2
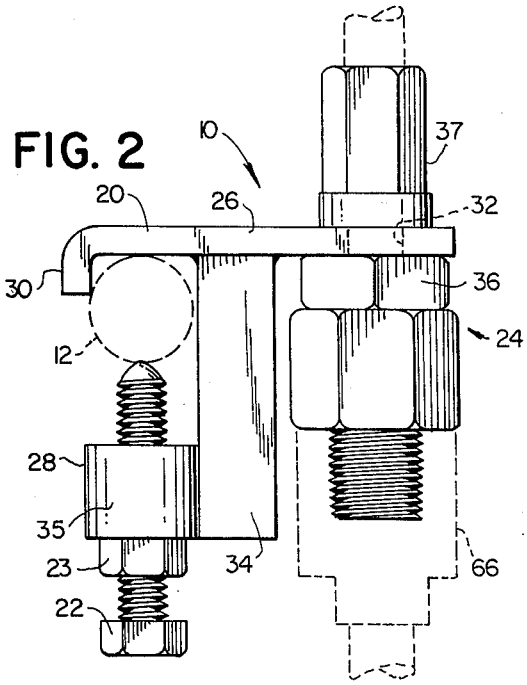
FIG. 5
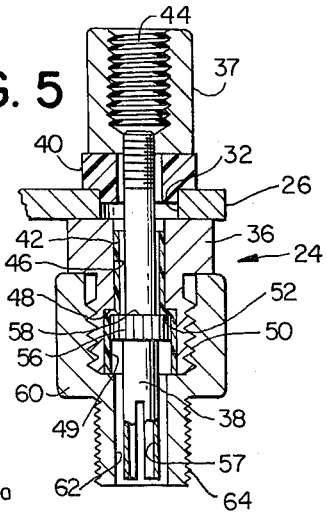
FIG. 6
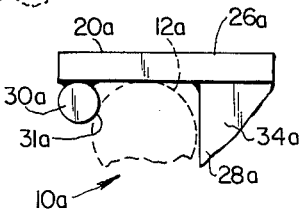

ANTENNA MOUNTING BRACKET

BACKGROUND OF THE INVENTION

This invention relates in general to antenna mounting brackets and deals more particularly with an improved mounting bracket for releasably securing an antenna to a member which supports a rear view mirror mounted externally on a truck or the like.

In the trucking industry it has become a common practice for drivers to provide their own citizen band radios. Since trucks are often assigned to and operated by more than one driver, most drivers prefer to remove their personally owned radio equipment from the trucks assigned to them upon completion of their runs. Further, because of the high incidence of theft of such portable radio equipment most long haul drivers follow the practice of removing their radio sets and antennas from their vehicles when the vehicles are parked overnight or for prolonged periods at truckstops or the like.

An antenna mounting bracket suitable for such usage must be adapted for rapid installation and removal with minimal inconvenience. It must also be of rugged durable construction to withstand abuse, since it may be installed on and removed from a vehicle one or more times during each working day. Further, such a mounting bracket should "fail safe" and not result in damage to the antenna in the event of faulty or careless installation. It is the general aim of this invention to provide an improved detachable antenna mounting bracket which satisfies these requirements.

SUMMARY OF THE INVENTION

In accordance with the present invention an improved detachable antenna mounting bracket is provided which includes a mounting frame carrying an antenna bushing assembly and a clamping member for releasably securing the mounting frame to an external rear view mirror support member on a motor vehicle. The mounting frame includes a substantially flat plate which has a downwardly projecting lip, extending along one edge thereof, and a generally L-shaped member which has a vertical leg integrally connected at its upper end to a central portion of the lower surface of the plate. The L-shaped member also has a horizontal leg which extends from the lower end portion of its vertical leg in spaced relation to the lower surface of the plate. A clamping member is threadably engaged with and extends through the horizontal leg in axially normal relation to the lower surface of the plate and is threadably movable generally toward and away from the lower surface. The axis of the clamping member intersects the lower surface of the plate intermediate the lip and the vertical leg.

BRIEF DESCRIPTION OF THE DRAWING

FIG. 1 is a fragmentary perspective view of a truck which has an antenna mounting bracket embodying the present invention mounted thereon.

FIG. 2 is a somewhat enlarged side elevational view of the antenna mounting bracket shown in FIG. 1.

FIG. 3 is a somewhat enlarged end elevational view of the antenna mounting bracket of FIG. 1.

FIG. 4 is a somewhat enlarged plane view of the antenna mounting bracket of FIG. 1.

FIG. 5 is a fragmentary sectional view taken along the line 5—5 of FIG. 4.

FIG. 6 is similar to FIG. 2, but shows another antenna mounting bracket embodying the invention.

DETAILED DESCRIPTION OF THE PREFERRED EMBODIMENTS

The detachable antenna mounting bracket of the present invention is particularly adapted for mounting a radio antenna on a motor vehicle which has an external rear view mirror carried by at least one generally horizontal support member which extends outwardly from the body of the vehicle. Referring to the drawing, in FIG. 1 an antenna mounting bracket embodying the present invention, and indicated generally by the reference number 10, is shown attached to a typical rear view mirror support member 12 on a truck 14. The illustrated antenna mounting bracket 10 carries an antenna rod 16 which is electrically insulated from the body of the vehicle. The antenna rod 16 is coupled to a flexible cable 18 which is connected in a conventional manner to a radio transmitter and/or receiver, located in the cab of the truck 14, to form an antenna circuit. Referring further to FIGS. 2–5, the mounting bracket 10 generally comprises a mounting frame 20 and a clamping member 22 for detachably securing the mounting frame to a mirror support member or the like, such as the illustrated support member 12, which comprises a cylindrical tube. An antenna bushing assembly, indicated generally at 24, mounted on and insulated from the mounting frame 20 supports the antenna rod 16 and couples it to the antenna cable 18, as will be hereinafter further discussed.

Considering the mounting bracket 10 in further detail, the illustrated mounting frame 20 includes a generally rectangular plate 26 and a generally L-shaped frame member 28 which is welded or otherwise secured to a central portion of the plate 26. A rear marginal portion of the plate 26 is bent downward and forms a lip 30 which extends along the rear edge of the plate, as it appears oriented in FIGS. 1, 2 and 4. A cylindrical mounting hole 32 is formed through the plate 26, near its forward end to receive the bushing assembly 24.

The L-shaped frame member 28 has a vertical leg 34 formed from a piece of bar stock. The upper end of the leg 34 is centrally secured to the lower surface of the plate 26. The other leg of the L-shaped frame member is formed from a piece of cylindrical bar stock 35 which is welded or otherwise secured to the lower end of the leg 34 in spaced relation to the lower surface of the plate 26. The distance between the forwardly facing surface of the lip 30 and the opposing rearwardly facing surface of the vertical leg 34 is approximately equal to the width or diameter of the cylindrical member 12 to which the antenna mounting bracket 10 is to be secured.

The clamping member 22 comprises a clamping screw threaded into and through the leg 35 in axially normal relation to the lower surface of the plate 26, substantially as shown in FIGS. 2 and 3. The axis of the clamping screw 22 intersects the lower surface of the plate 26 approximately midway between the opposing surfaces of the lip 30 and the leg 34, as shown in FIG. 2. Preferably, and as shown the clamping screw 22 carries a lock nut 23.

The antenna rod 16 is threaded at its lower end and supported on the mounting frame 20 by an antenna coupling nut 37 which comprises a part of the antenna bushing assembly 24. The bushing assembly further includes a cable coupling member 36 and an electrical conducting member or terminal member 38 which extends through the hole 32 and maintains the coupling nut 37 and the coupling member 36 in assembly with the mounting frame 20. The terminal member 38 also provides electrical connection between the antenna rod and the cable 18. An insulating washer 40, mounted between the connecting nut 37 and the upper surface of the plate 20, and an insulating element 42, contained within the cable coupling member 36, serve to electrically insulate the terminal member 38 from the frame member 20, as best shown in FIG. 5.

The antenna coupling nut 37 has a stepped bore 44 which includes an upwardly opening threaded upper end portion into which the lower end of the antenna rod 16 is threaded. The lower end portion of the bore 44 is of somewhat reduced diameter and is internally threaded to receive an externally threaded upper end portion of the terminal member 38. The washer 40 is made from a suitable electrical insulating material such as plastic and has an outside diameter substantially larger than the diameter of the hole 32. A reduced diameter portion of the washer 40 is received within the hole 32 and retains the washer 40 in coaxial alignment with the hole.

The cable coupling member 36 is mounted adjacent the lower surface of the plate 26 and has a vertically disposed coaxial stepped bore 46 which extends through it. The lower end portion of the bore 46 is diametrically enlarged so that a downwardly facing annular bearing surface 48 is formed at the junction between the upper and lower portions of the bore. The lower end portion of the coupling member 36 is of somewhat reduced diameter and has an external thread 50 formed thereon, as shown in FIG. 5. The insulating element 42 comprises a thin walled sleeve of electrical insulating material which is received within and complements a substantial portion of the stepped bore 46. The sleeve 42 is also formed with a coaxial stepped bore 49 and has a diametrically enlarged lower end portion. A downwardly facing seating surface 52 is formed at the junction between the upper and lower end portions of the sleeve bore.

The terminal member 38 is formed from electrically conductive material and has an elongated stem, the upper end portion of which is threaded for connection to the antenna coupling nut 37, as previously discussed. The member 38 is formed with a diametrically enlarged annular collar 56 intermediate its ends. The collar 56 has an upwardly facing bearing surface 58 which engages the downwardly facing seating surface 52 when the bushing assembly is assembled with the mounting frame. The outside diameter of the collar 56 is approximately equal to the inside diameter of the lower end portion of the sleeve bore 49. However, if desired, the outside diameter of the collar may be slightly larger than the inside diameter of the corresponding portion of the sleeve bore 49 in which it is received. When the collar is made in this manner, its peripheral surface is preferably serrated or knurled. The collar is then forceably fitted into the sleeve bore 49 so that the terminal member 38 resists rotation relative to the sleeve 42 and the cable coupling member 36. This arrangement of the collar aids in assemblying the bushing assembly 24 with the mounting frame 20.

The lower end portion of the terminal member 38 has a blind downwardly opening bore 57. Diametrically opposed slots in the walls of the resilient terminal member 38 communicate with the latter bore to adapt the terminal member to receive an axially extending jack associated with the cable 18, as is well known in the art. The illustrated bushing assembly 24 also includes an adaptor nut 60 which is threaded at its upper end to engage the male thread 52. At its lower end the adaptor 60 has a cylindrical bore 62 somewhat larger than the cylindrical lower end portion of the terminal member 38 which extends into the latter bore in spaced relation to the bore wall. The lower end portion of the adaptor has a male thread 64 formed thereon for receiving a connecting nut associated with the cable 18, such as the nut 66 indicated in broken lines in FIG. 2.

In attaching the antenna mounting bracket 10 to the vehicle 14 it is only necessary to loosen the clamping screw 22 an amount sufficient to permit the mirror support member 20 to pass freely between the lip 30 and the upper end of the clamping screw. The clamping screw is then tightened into engagement with the support member 12 while the antenna rod 16 is maintained in a desired generally vertical position. After the mounting bracket 10 has been secured by the clamping screw 22, the lock nut may be brought into locking engagement with the lower leg 35 to further secure the clamping screw so that it will not loosen due to road vibration. The antenna cable 18 may remain connected to the mounting bracket 10 so that it is only necessary to establish a plugging connection between the radio unit and the antenna cable to complete the installation. The antenna mounting bracket 10 may be removed from the vehicle by merely disengaging the lock nut and loosening the clamping screw 22 and unplugging or otherwise disconnecting the cable 18 from the radio set within the cab of the vehicle.

If the clamping screw 22 should become loosened due to road vibration the antenna mounting bracket 10 may swivel about the support member 12 allowing the antenna rod 16 to assume a generally depending position, however, the lip 30 and the clamping screw 22 will cooperate to prevent the mounting bracket 10 from separating from the vehicle. The mounting bracket 10 will remain connected to the support member 12 until the vehicle 14 can be brought to a stop so that the clamping screw 22 may be resecured. This safety feature prevents the antenna from becoming damaged due to faulty or careless installation.

Referring now to FIG. 6, another antenna mounting bracket embodying the present invention is indicated generally by the reference numeral **10*a*. The mounting bracket 10*a* is similar in most respects to the mounting bracket 10, previously described, and differs therefrom only in the arrangement of its depending lip. More specifically, the mounting bracket 10*a* includes a mounting frame 20*a* framed by a substantially flat generally rectangular plate 26*a* and a generally L-shaped frame member 28*a* which depends from a central portion of the plate 26*a* and includes a vertical leg 34*a*, as previously described. The plate 20*a* has a depending lip 30*a* which extends along its rear edge. The lip is formed by a generally cylindrical bar welded or otherwise suitably secured to the lower surface of the plate 20*a* and has a rounded edge portion 31*a* which extends therealong and faces generally in the direction of the leg 43*a*. When the mounting bracket is secured to a support member, such as the mirror support member indicated at 12*a*, the rounded edge 31*a* bears on the support member so that the edge 31*a*, the leg 34 and the end of the clamping screw (not shown) may establish three points of contact with the support member 12*a*, whereby to firmly secure the mounting bracket 10*a*** to the support member.

I claim:

1. The combination comprising an elongated generally horizontally extending external rear view mirror support member on a motor vehicle and an antenna mounting bracket releasably secured to said mirror support member, said mounting bracket including a mounting frame, an antenna bushing assembly carried by said mounting frame, and a clamping fastener releasably securing said mounting frame to the mirror support member, said mounting frame including a substantially flat horizontally disposed plate having a downwardly projecting lip extending along its rear edge and a generally L-shaped member having one leg connected in fixed position at its upper end to a central portion of the lower surface of said plate in forwardly spaced relation to said rear edge and extending downwardly beyond the lower surface of said plate, said L-shaped member having another leg connected in fixed position to a lower end position of said one leg and extending rearwardly therefrom in spaced relation to said lower surface, said lip and said one leg defining opposing surfaces receiving the support member therebetween and engaging generally opposite sides of the support member, said clamping fastener threadably engaged with and extending upwardly through said other leg in axially normal relation to said lower surface, said clamping fastener having a free upper end in direct clamping engagement with the support member, said clamping fastener being threadably movable relative to said other leg and generally toward and away from said lower surface, the axis of said clamping fastener intersecting said lower surface generally midway between said opposing surfaces, said plate having a hole therethrough intermediate said one leg and the forward edge of said plate, said antenna bushing assembly including a cable connecting member disposed at one side of said plate and having a stepped bore extending therethrough in coaxial alignment with said hole, said stepped bore defining an axially outwardly facing first bearing surface, an electrical connector having an axially elongated stem disposed within and extending from said bore through said hole and beyond said plate, said electrical connector having an enlarged collar defining a second bearing surface disposed in opposing relation to said first bearing surface, an antenna coupling nut for electrically coupling to and supporting an antenna rod disposed at the side of said plate opposite said one side and threadably engaged with the extending end of said stem, and means for electrically insulating said electrical connector and said coupling nut from said plate and said cable connecting member.

2. The combination as set forth in claim 1 wherein said lip has a rounded edge extending therealong and facing in the general direction of said rear edge.

3. The combination as set forth in claim 2 wherein said lip is defined by a cylindrical bar integrally secured to said lower surface of said flat plate.

4. The combination as set forth in claim 1 wherein said clamping fastener comprises a bolt.

* * * * *

UNITED STATES PATENT AND TRADEMARK OFFICE

CERTIFICATE OF CORRECTION

PATENT NO. : 4,209,788

DATED : June 24, 1980

INVENTOR(S) : George W. Plantier

It is certified that error appears in the above-identified patent and that said Letters Patent are hereby corrected as shown below:

Column 5, line 19, "position" should be --portion--.

Column 6, line 19, "connector" should be --conductor--.

Signed and Sealed this

*Twenty-eighth* Day of *October 1980*

[SEAL]

*Attest:*

SIDNEY A. DIAMOND

*Commissioner of Patents and Trademark*

*Attesting Officer*